US005504943A

United States Patent [19]

Han

[11] Patent Number: 5,504,943

[45] Date of Patent: Apr. 9, 1996

[54] HEADGEAR HAVING AN ATTACHABLE WHISTLE

[76] Inventor: Hong Y. Han, 226-10 Kodeok-dong, Kangdong-Ku, Seoul, Rep. of Korea

[21] Appl. No.: 254,291

[22] Filed: Jun. 6, 1994

[30] Foreign Application Priority Data

Oct. 22, 1993 [KR] Rep. of Korea ..... 93-21752

[51] Int. Cl.[6] ..... A42B 1/24

[52] U.S. Cl. ..... 2/209.13; 2/195.1; 2/906; 446/27

[58] Field of Search ..... 2/171, 175.1, 195.1, 2/209.13, 906, 909, 918, DIG. 11; 116/137 R; 446/27

[56] References Cited

U.S. PATENT DOCUMENTS

| | | | |
|---|---|---|---|
| 2,640,980 | 6/1953 | Prupis | 2/209.13 |
| 2,654,973 | 10/1953 | Lemelson | 446/27 |
| 2,788,439 | 4/1957 | Hesse | 446/27 |
| 3,435,556 | 4/1969 | Clarke | 446/27 |
| 5,265,165 | 11/1993 | Rauch | 2/209.13 |

*Primary Examiner*—Diana Biefeld
*Attorney, Agent, or Firm*—Michael N. Meller

[57] ABSTRACT

A headgear having an attachable whistle, comprises a pair of perforations(2), a pair of protrudes(8) fixed on the inner part of the disc(3) to fit the disc with the cap(1), and a connecting mean(4) to connect the disc(3) with a flexible electric wire(6) of which a whistle(7) is suspended in one end, via a decoration clip(5) characterized in that, when an user blow up the whistle(7), it makes a sound like a harmonica or a whistle and on the other hand when the user press down a button(**3*b*) of the electric disc(3) secured on one side of the cap(1), it make an electric sound and twinkled a lamp (3*a***) .

6 Claims, 2 Drawing Sheets

HEADGEAR HAVING AN ATTACHABLE WHISTLE

BACKGROUND OF THE INVENTION

This invention relates to a headgear having an attachable whistle.

Generally, a cap(or a hat) has been simply used to just shield the light while the present invention is to provide a headgear having a whistle to give an entertainment to user, and especially the whistle designed to be attachable so to optimize the present invention.

BRIEF DESCRIPTION OF THE DRAWINGS

The above and other objects and advantages of the invention will be apparent from consideration of the following detailed description, taken in conjunction with accompanying drawings, in which like reference characters refer to like parts throughout, and in which.

DETAILED DESCRIPTION OF THE INVENTION

Figure 1:
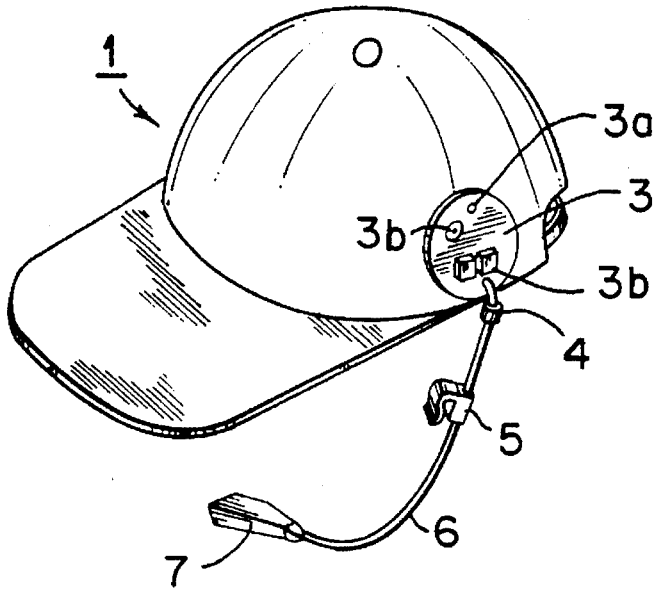
FIG. 1 is a perspective view of the present invention.
Figure 2:
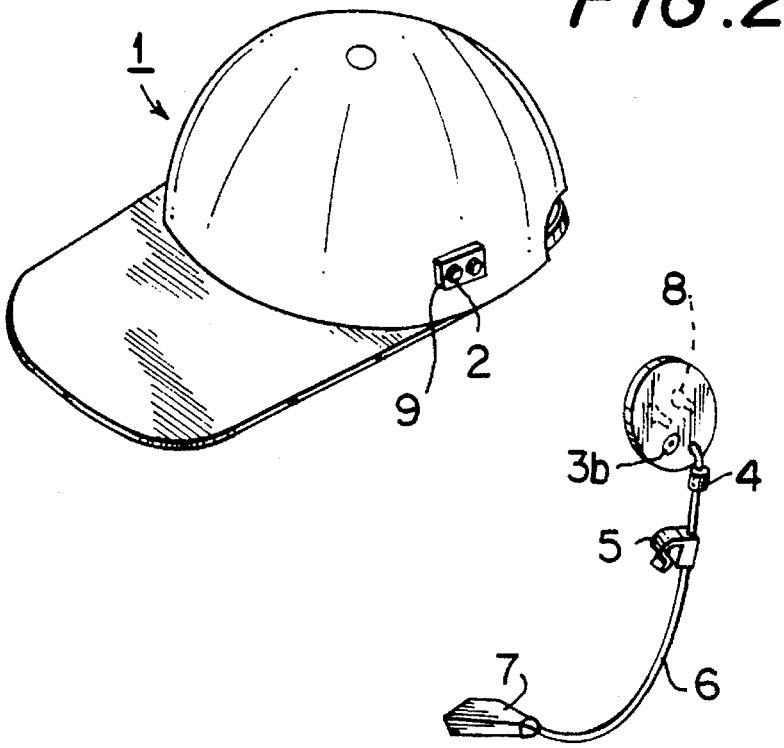
FIG. 2 is a separate view of the invention.
Figure 3:
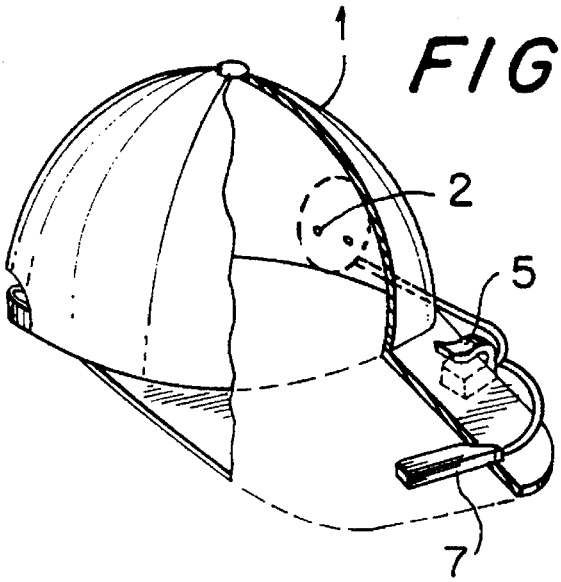
FIG. 3 is a partially exploded perspective view of the present invention.

According to the FIG. 1 to the FIG. 3, an electric disc(3) is attached to a connecting bracket(9) provided a pair of perforations (2) on one side of a cap(l).

The electric disc(3) is firmly secured to the cap(1) as a pair of protrudes(8), fixed on the inner part of the disc(3), are fit into the perforations(2) of the bracket(9), and the disc(3)) is connected with a flexible electric wire(6) of which a whistle(7) is suspended in one end, via a connecting means (4).

Furthermore, the present invention may be provided a decoration clip(5) to be fitted in a visor of the cap(1)

Consequently, when a user blows up the whistle(7), it makes a sound like a harmonica or a whistle and on the other hand when the user pressedown a button(3*a*) of the electric disc(3) secured on one side of the cap(1), it contacts with a circuit board installed in the electric disc(3) so that make an electric sound and a lamp(3*b*) to be twinkled.

Alternatively said the electric disc(3) having the attachable whistle(7) may be secured to the headgear by means of mounting tape or hook and loop fasteners arranged inside of the electric disc(3) and side bracket(9) of the headgear(not shown).

Figure 4:
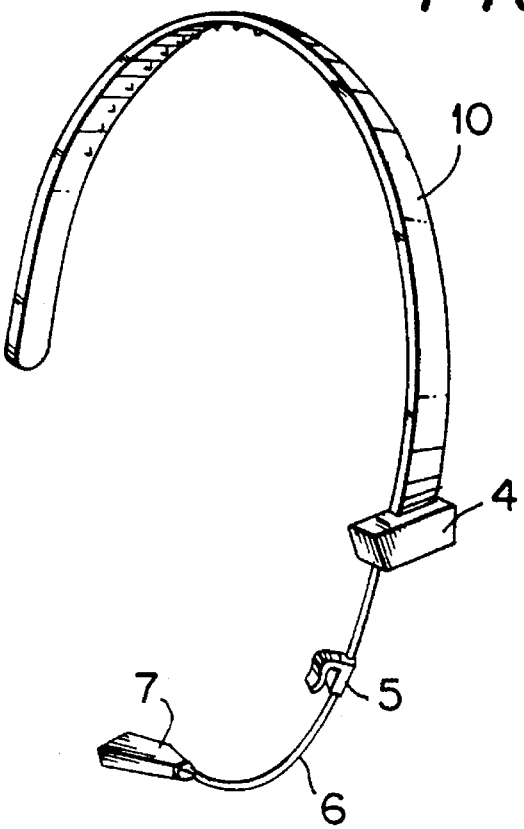
FIG. 4 is a perspective view of an another embodiment of the invention.

FIG. 4 shows an another embodiment that is adapted to a hair-band(10). According to this embodiment, the electric disc(3) is secured to the side bracket(9) of the hair-band and other functions are same with the first embodiment.

The present invention may be used in various kinds of sports games or outdoor event, instead of whistle, and moreover can be used for self protection for female.

I claim:

1. A headgear having an attachable whistle, comprising mounting means attached to said headgear, said mounting means being formed with at least two openings, a disc capable of producing an audible sound and having at least two protruding members for cooperating with said openings to mount said disc on said headgear, operating means mounted on said disc for producing said audible sound when desired, electrical connecting means for electrically coupling said disc to said whistle and for suspending said whistle at a desired position with respect to said headgear whereby when said whistle is blown or said operating means is operated, an audible sound is produced.

2. A headgear having an attachable whistle, as in claim 1, wherein said disc is secured to the headgear by means of mounting tape or hook and loop fasteners respectively arranged on said disk and mounting means of the headgear.

3. A headgear having an attachable whistle, as in claim 1 wherein said headgear is a hairband.

4. A headgear as claimed in claim 1 wherein said disc is provided with a lamp that is illuminated when said operating means is operated.

5. A headgear as claimed in claim 1 wherein said operating means is a button mounted on said disc.

6. A headgear as claimed in claim 1 wherein a clip is provided on said electrical connecting means for removably attaching said electrical connecting means and said whistle suspended thereon to said headgear.

* * * * *